United States Patent [19]

Toshimitsu et al.

[11] Patent Number: 4,805,579

[45] Date of Patent: Feb. 21, 1989

[54] METHOD OF CONTROLLING FUEL SUPPLY DURING ACCELERATION OF AN INTERNAL COMBUSTION ENGINE

[75] Inventors: Kazushige Toshimitsu; Tadashi Umeda; Hisashi Igarashi, all of Wako, Japan

[73] Assignee: Honda Giken Kogyo Kabushiki Kaisha, Tokyo, Japan

[21] Appl. No.: 8,241

[22] Filed: Jan. 29, 1987

[30] Foreign Application Priority Data

Jan. 31, 1986 [JP] Japan ..... 61-19877
Feb. 14, 1986 [JP] Japan ..... 61-30108

[51] Int. Cl.[4] ..... F02D 41/10
[52] U.S. Cl. ..... 123/492; 123/326
[58] Field of Search ..... 123/492, 326

[56] References Cited

U.S. PATENT DOCUMENTS

| | | | |
|---|---|---|---|
| 3,926,153 | 12/1975 | Reddy | 123/492 |
| 3,983,851 | 10/1976 | Hoshi | 123/492 |
| 4,227,507 | 10/1980 | Takase et al. | 123/492 |
| 4,266,275 | 5/1981 | Marchak | 123/492 |
| 4,356,803 | 11/1982 | Miyagi | 123/492 |
| 4,364,363 | 12/1982 | Miyagi et al. | 123/492 |
| 4,389,997 | 6/1983 | Nakano et al. | 123/492 |
| 4,463,730 | 8/1984 | Kishi | 123/492 |

FOREIGN PATENT DOCUMENTS 58-202335 11/1983 Japan .

*Primary Examiner*—Andrew M. Dolinar
*Attorney, Agent, or Firm*—Armstrong, Nikaido, Marmelstein & Kubovcik

[57] ABSTRACT

A method of controlling fuel supply during beginning acceleration and acceleration after the interruption of fuel supply of an internal combustion engine is provided wherein a basic fuel supply amount which is determined in accordance with stable operating conditions of the engine is increased when it is detected that the throttle valve of the engine is opened from its almost closed position. The method comprises the steps of determining a reference value by adding a predetermined value of the throttle valve opening to a detected amount or value of throttle valve opening when it is detected that the throttle valve is opened from its almost closed position. The basic fuel supply amount is additionally correctionally increased if the correctional increase of the basic fuel supply amount, which was initiated upon detection of opening of the throttle valve, has not yet reached an end when the detected value of the opening of the throttle valve reaches the throttle valve opening reference value. Further methods of controlling fuel supply during acceleration are also provided wherein the additional correctional increase is a function of engine load or acceleration rather than throttle valve opening.

8 Claims, 4 Drawing Sheets

METHOD OF CONTROLLING FUEL SUPPLY DURING ACCELERATION OF AN INTERNAL COMBUSTION ENGINE

BACKGROUND OF THE INVENTION

1. Field of the Invention

This invention relates to a method of controlling the fuel supply to an engine during acceleration during the starting of movement of a vehicle, that is when the vehicle begins moving from zero speed (hereinafter called beginning or starting acceleration), and during acceleration of the internal combustion engine after there has been a cut in the fuel supply, and more particularly, to a method of controlling the fuel supply when the throttle valve is opened for starting acceleration or for acceleration after interruption of the fuel supply of an internal combustion engine. In a further aspect, the invention relates in particular, to a method of controlling fuel supply during acceleration of the engine in response to a change of load on the engine.

2. Description of the Prior Art

Generally, when an accelerator pedal is pushed down to open a throttle valve from its almost closed position in order to start the movement of a vehicle, it is pushed down moderately when high or rapid acceleration is not required. However, where rapid acceleration is required, the accelerator pedal is push down rapidly. There is a problem however in that a mere increase in the predetermined amount of fuel supply upon opening of a throttle valve will not increase the fuel supply in accordance with the pushing down of the accelerator pedal and hence the desired acceleration will not be attained. A similar problem appears also when a car is accelerated after interruption or cut of the fuel supply.

Further, in a typical conventional method of controlling fuel supply upon acceleration of an internal combustion engine, the fuel supply is correctionally increased in response to an amount of change (a differential value) of opening of a throttle valve when a load is applied to the engine, for example, when the amount of change of the throttle valve opening, exceeds a predetermined value. In this method, when the amount of change of throttle valve opening is not large, the change in the throttle valve opening continues for a relatively long time, and fuel is increased sufficiently while the opening of the throttle valve is changing. However, when the amount of change of the throttle valve opening is large and hence the change in the opening of the throttle valve ends in a short time, the fuel supply will not be sufficiently increased.

SUMMARY OF THE INVENTION

It is an object of the present invention to provide a method of controlling fuel supply during beginning acceleration and acceleration after fuel interruption of an internal combustion engine which allows an increase in the fuel supply in accordance with the pushing down of the accelerator pedal from its almost closed position, that is, in accordance with the change in the opening of a throttle valve.

It is another object of the present invention to provide a method of controlling fuel supply during acceleration of an internal combustion engine which can allow an appropriate increase of fuel supply, even when there is a change of the load on the engine which is determined in response to an opening of a throttle valve and other parameters, which comes to an end in a short period of time. This allows an increase of fuel supply which precisely corresponds to any delicate change of the engine load.

According to the present invention, there is provided a method of controlling fuel supply during beginning acceleration and acceleration of an internal combustion engine after a fuel interruption, wherein a basic fuel supply amount, which is determined in accordance with stable operating conditions of the engine, is increased when it is detected that the throttle valve of the engine is opened from its almost closed position. The method comprises the steps of determining a reference value by adding a predetermined value of the throttle valve opening to a detected amount or value of throttle valve opening when it is detected that the throttle valve is opened from its almost or substantially closed position. The basic fuel supply amount is additionally correctionally increased if the correctional increase of the basic fuel supply amount which was initiated upon detection of opening of the throttle valve has not yet reached an end when the detected value of the opening of the throttle valve reaches the throttle valve opening reference value.

According to another aspect of the present invention, there is provided a method of controlling the fuel supply during acceleration of an internal combustion engine wherein a basic fuel supply amount, which is determined in response to a normal operating condition of the engine, is correctionally increased when a differential value of a detected value, indicative of a load on the engine, exceeds a predetermined value. The method comprises the steps of adding a predetermined value to the detected value indicative of the engine load (hereinafter the "engine load") to provide a reference value of the engine load when the differential value of the engine load exceeds the predetermined value, and additionally, increasing the correctionally increased basic fuel supply amount if the correctional increase of the basic fuel supply amount, which was started when the differential value of the engine load exceeded the predetermined value, has not ended when the detected value of the engine load reaches the reference value.

DETAILED DESCRIPTION OF THE PREFERRED EMBODIMENT

Figure 1:
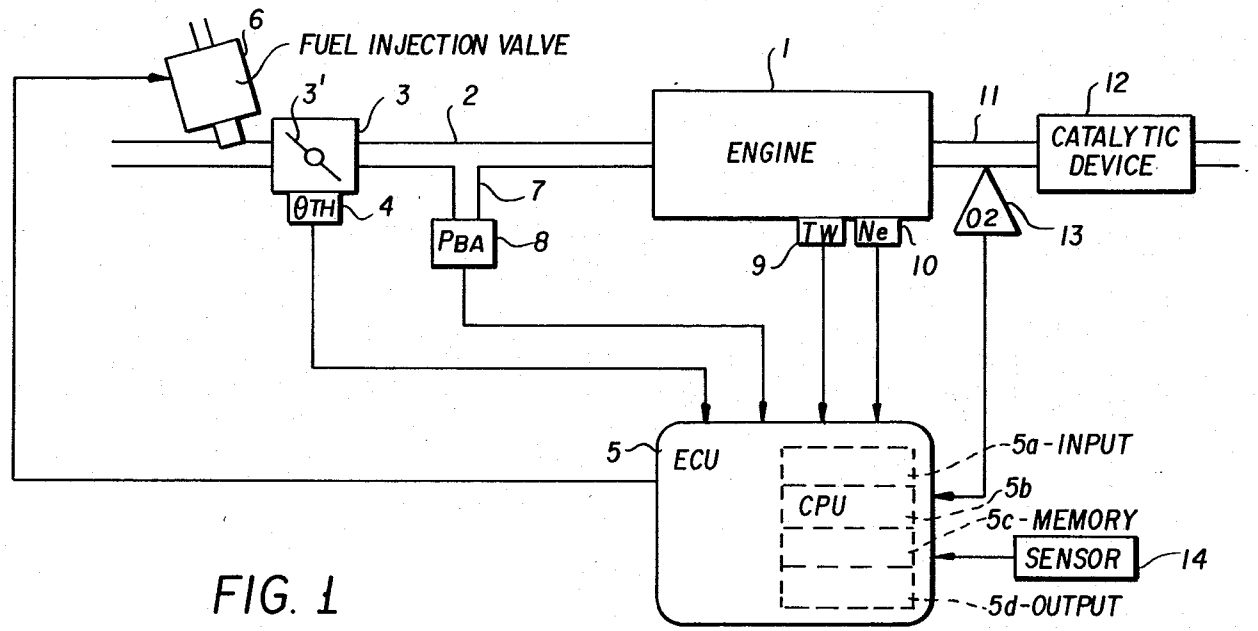
FIG. 1 is a diagrammatic representation showing a fuel supply controlling apparatus for an internal combustion engine to which the methods of the present invention are applied.

FIG. 1 is a block diagram of a fuel supply controlling apparatus to which a method of the invention is applied.

An internal combustion engine 1 is for example, a 4-cylinder internal combustion engine. A suction pipe 2 is connected to the engine 1, and a throttle body 3 is provided in a mid portion of the suction pipe 2 and has a throttle valve 3' located therein. A throttle valve opening ($\theta$th) sensor 4 is provided for the throttle valve 3' and operates to convert the amount of opening of the throttle valve 3' into an electric analog signal which is applied to an electronic control unit (hereinafter referred to as "ECU") 5. The throttle valve opening sensor may be, for example, a potentiometer.

A fuel injection valve 6 is located in suction pipe 2 upstream of the throttle body 3 so that fuel may be supplied to all cylinders of the internal combustion engine 1. The fuel injection valve 6 is connected to a fuel pump, not shown, and is electrically connected to the ECU 5 so that the opening period of the fuel injection valve 6 is controlled by a signal from the ECU 5.

Meanwhile, an absolute pressure ($P_{BA}$) sensor 8 is provided downstream of the throttle valve 3' through pipe 7, and thus an absolute pressure signal, which is converted into an electric signal by the absolute pressure sensor 8, is delivered to the ECU 5.

An engine cooling water sensor (hereinafter referred to as "$T_W$ sensor") 9 is provided for the engine 1. The $T_W$ sensor 9 may comprise a thermistor or a like element and is fitted into a circumferential wall of the engine cylinders in which cooling water is filled. Thus, the $T_W$ sensor 9 detects a temperature of the cooling water and delivers a corresponding detected water temperature signal to the ECU 5. An engine rotational speed sensor (hereinafter referred to as the "Ne sensor") 10 is mounted on an outer periphery either of a cam shaft or a crank shaft of the engine (not shown). The Ne sensor 10 develops a crank angle position signal (hereinafter referred to as a "TDC signal") at predetermined angular positions of the crank shaft of the engine which are spaced by an angle of 180° from each other, that is, at predetermined angular positions of the crank shaft spaced ahead by a predetermined angle from the top dead center (TDC) of each cylinder. The TDC signal is delivered to the ECU 5.

A three-way catalytic device 12 is provided in exhaust pipe 11 of the engine 1 for removing HC, CO and NOx components from the exhaust gas in order to purify the exhaust gas. An $O_2$ sensor 13 is fitted into the exhaust pipe 11 on the upstream side of the three-way catalytic device 12 and is operable to detect the concentration of oxygen in exhaust gas and deliver an $O_2$ concentration signal to the ECU 5.

A further parameter sensor 14 such as, for example, an atmospheric pressure sensor is connected to the ECU 5 and provides a detected value signal to the ECU 5.

The ECU 5 includes an input circuit 5*a* which shapes the waveform of the input signals from various sensors, corrects the voltage levels to a predetermined level and converts analog signals into digital signals. The ECU 5 further includes a central processing unit (hereinafter referred to as a "CPU") 5*b*, storage or memory means 5*c* for storing therein various operating programs to be executed by the CPU 5*b* and the results of such operations, and an output circuit 5*d* for delivering a driving signal to the fuel injection valve 6.

Each time a TDC signal is received, the CPU 5*b* calculates, in response to engine parameter signals from the various sensors delivered thereto via the input circuit 5*a*, a fuel injection period $T_{OUT}$ for the fuel injection valve 6. The fuel injection period is determined by the following equation:

$$T_{OUT}=Ti\times K_1+T_{Acc}+K_2 \quad (1)$$

where Ti is a basic fuel amount reference value of the injection period of the fuel injection valve 6, Ti being determined as a function of engine rotational speed Ne, and the absolute pressure $P_{BA}$ within the suction pipe; $T_{Acc}$ is an increasing correction value in accordance with which an acceleration increase of fuel (synchronous acceleration increase) which is carried out in a synchronous relationship with a TDC signal; and $K_1$ and $K_2$ are correction coefficients or correction variables which are calculated from the engine parameter signals from the various sensors in accordance with predetermined operating formulas so that various characteristics such as engine starting characteristic, an exhaust gas characteristic, a fuel consumption characteristic and an acceleration characteristic may be optimized in response to the operating condition of the engine.

The CPU 5*b* thus produces, in response to a fuel injection time $T_{OUT}$ determined in accordance with the equation (1) above, a driving signal for opening the fuel injection valve 6 and delivers it to the fuel injection valve 6 via the output circuit 5*d* after finishing the calculation of equation (1).

Further, each time a timer signal which is generated at fixed intervals of time is received, the CPU 5*b* calculates a valve opening time $T_{MA}$ for the fuel injection valve 6 in response to engine parameter signals from the various sensors and applies a driving signal for opening the fuel injection valve 6, in response to the valve opening time $T_{MA}$ thus calculated, to the fuel injection valve 6 in order to increase the fuel supply for acceleration control which is not synchronized with a TDC signal. Such an increase of fuel supply is hereinafter referred to as an "asynchronous acceleration increase".

The asynchronous acceleration increase is effected to supply the shortage in asynchronous acceleration increase in response to a TDC signal, for example, upon starting acceleration, rapid acceleration, or a load increase and is required in particular, where the interval between the pulse generation of TDC signals is relatively long, i.e., when the engine is rotating at a relatively low speed.

The asynchronous acceleration fuel increase control, in which opening time control of the fuel injection valve 6 is controlled by the CPU 5*b* of the ECU 5, will be described.

Figure 2:
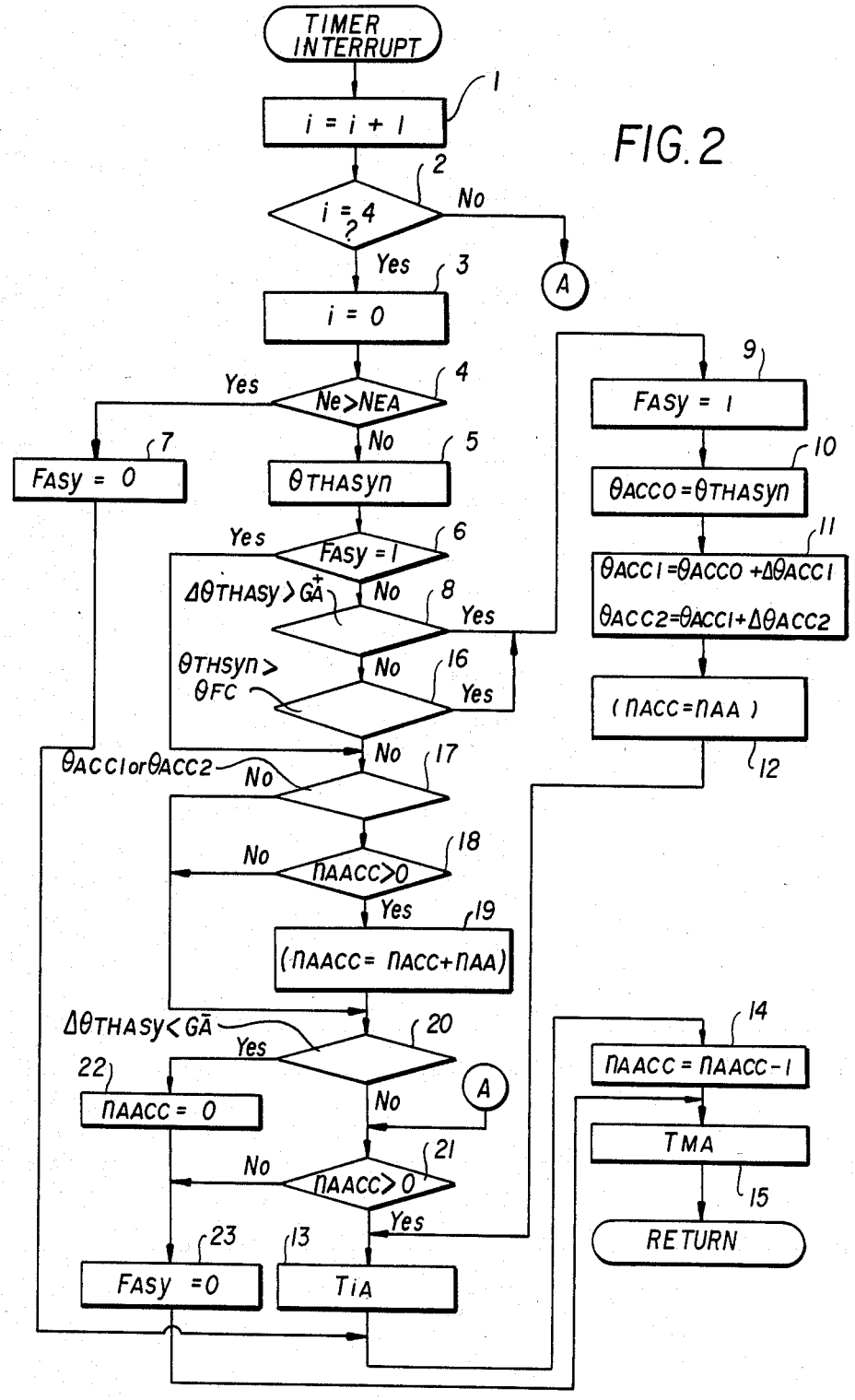
FIG. 2 is a flow chart of the program of an asynchronous acceleration increasing correction subroutine in accordance with the present invention, which is executed by the electronic control unit (ECU) of FIG. 1.

FIG. 2 is a flow chart of a program for an asynchronous acceleration increase correction subroutine executed in the CPU 5*b* of FIG. 1. The program shown is executed in a synchronized relationship with a timer signal of a predetermined period $t_{TR}$ (for example, 10 milliseconds). The program is utilized with both aspects of the present invention.

At first at step 1 of FIG. 2, the variable i is incremented by 1. It is to be noted that the variable i is set to 0 upon initialization. In step 2, it is determined whether or not the variable i is equal to 4, and when the result of the determination is affirmative (Yes), the variable i is set to 0 and the operations of step 4 and the steps following step 4, which will be hereinafter described will be carried out. However, if the result of the determination at step 2 is negative (No), steps 21, 23 and 13 to 15 are carried out (from A to A in FIG. 2). Thus, step 4 and the steps following step 4, are carried out after each $4t_{TR}$ (for example, 40 milliseconds), and in any other case, steps 21, 23 and 13 to 15 are carried out.

At step 4, it is determined whether or not the engine rotational speed Ne is higher than a predetermined asynchronous acceleration determining rotational speed $N_{EA}$ (for example, 2800 r.p.m.). Since the pulse generation interval of TDC signals decreases as the engine rotational speed Ne increases, when $N_E > N_{EA}$ the increase of fuel supply to the engine upon acceleration can be limited only to a synchronous acceleration increase by TDC signals in order to obtain good results for sufficient acceleration responsiveness, and hence the asynchronous acceleration increase is ended. Accordingly, when the result of the determination at step 4 is affirmative (Yes), $F_{Asy}$ which is to be determined at step 6 described below is reset to 0 (step 7), and then steps 14 and 15 described below are carried out and the program comes to an end.

However, when the result of the determination at step 4 is negative (No), a detected throttle valve opening $\theta_{THAsyn}$ for the present loop is read at step 5 from the throttle valve opening sensor 4. Then at step 6, it is determined whether or not the flag $F_{Asy}$ is 1, and when the result of the determination is negative (No), it is determined whether or not a differential value $\Delta\theta_{THAsyn}$ $[(\theta_{THAsyn})-(\theta_{THAsyn-1})]$between the detected throttle valve opening $\theta_{THAsyn}$ read at step 5 for the present loop and a detected throttle valve opening $\theta_{THAsyn-1}$ read at step 5 for the preceding loop is greater than a predetermined value $G_A+$ (for example, 20° per second) (step 8). The differential value may also be a derivative of $\theta_{THAsyn}$. When the result of the determination at step 8 is affirmative (Yes), this is indicative of a load on the engine. The flag $F_{Asy}$ is then set to 1 (step 9) and the value $\theta_{Acc0}$ is set to the throttle opening $\theta_{THAsyn}$ for the present loop (step 10). Subsequently, a predetermined value $\Delta\theta_{Acc1}$ is added to the $\theta_{Acc0}$ to obtain a first reference value $\theta_{Acc1}$, and then another predetermined value $\Delta\theta_{Acc2}$ is added to the first reference value $\theta_{Acc1}$ to obtain a second reference value $\theta_{Acc2}$ (step 11). Then, the asynchronous valve opening pulse number $n_{AAcc}$ described below for the fuel injection valve 6, is set to a predetermined value $n_{AA}$ (for example, to 4 after completion of warming up of the engine, and to 6 in any other instance). The value of $n_{AA}$ is determined in response to the engine water temperature $T_W$. The process then advances to step 13. The valve opening pulse number $n_{AAcc}$ is the number of pulses of a valve opening pulse signal for the fuel injection valve 6 which are generated one after another at predetermined time intervals (for example, 10 milliseconds).

Figure 3:
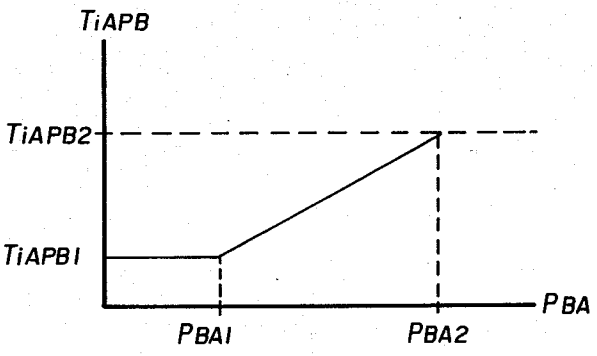
FIG. 3 is a lookup table diagram showing a reference value opening time relative to the absolute pressure within a suction pipe.
Figure 4:
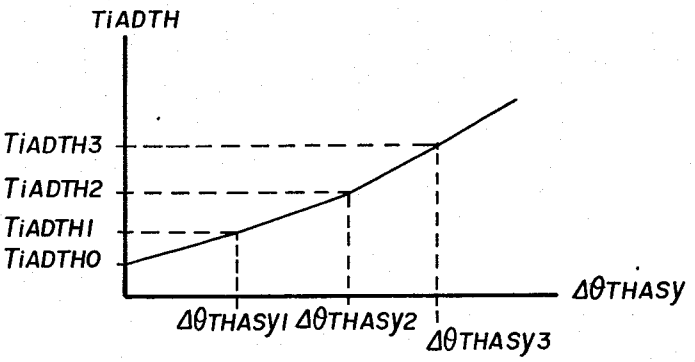
FIG. 4 is a lookup table diagram showing a reference value opening time relative to the amount of change of the throttle valve opening.

At step 13, a reference time $Ti_{APB}$ corresponding to an absolute pressure $P_{BA}$ within the suction pipe is read out from a table as shown in FIG. 3, and then reference time $Ti_{ADTH}$ corresponding to the differential value $\Delta\theta_{THAsy}$ of the throttle valve opening is read out from another table as shown in FIG. 4, whereafter an asynchronous acceleration increasing reference value $Ti_A$ is calculated from the reference times $Ti_{APB}$ and $Ti_{ADTH}$ by a following equation (2) (step 13).

$$Ti_A = Ti_{APB} + Ti_{ADTH} \quad (2)$$

Subsequently, the pulse number $n_{AAcc}$ is decremented by 1 (step 14), and then an opening time $T_{MA}$ for the fuel injection valve 6 is calculated from $Ti_A$ calculated by the equation (2) by the following equation (3) (step 15).

$$T_{MA} = Ti_A \times K'_1 \quad (3)$$

where $K'_1$ is a correction coefficient which is determined in response to the engine water temperature $T_W$ and other parameters.

Meanwhile, when the result of the determination at step 6 is affirmative (Yes), the process advances to step 17. Once steps 9 to 12 are carried out as a result of the determination at step 6, unless either step 7 or 23 is carried out, the steps 9 to 12 will not be carried out again because the flag $F_{Asy}$ has been set to 1 in step 9.

Further, when the result of the determination at step 8 is negative (No), it is determined whether or not the throttle valve opening $\theta_{THAsyn-1}$, which was read in the preceding loop, is lower than a throttle valve opening $\theta_{FC}$, being a value of a deceleration fuel cut requirement (an almost or substantially closed position), and whether the throttle valve opening $\theta_{THAsyn}$ for the present loop is higher than the throttle valve opening $\theta_{FC}$ of the deceleration fuel cut value (step 16). When the result of the decision is affirmative (Yes), this indicates starting acceleration or an acceleration after there has been a fuel cut. The process then goes to step 9 so that steps 9 to 15 may be carried out as described hereinabove. In this instance, $\theta_{Acc0}$ at step 10 is set to an opening $\theta_{THAsyn}$ ($\approx\theta_{FC}$) which is substantially equal to the throttle valve opening for fuel cutting.

Figure 5:
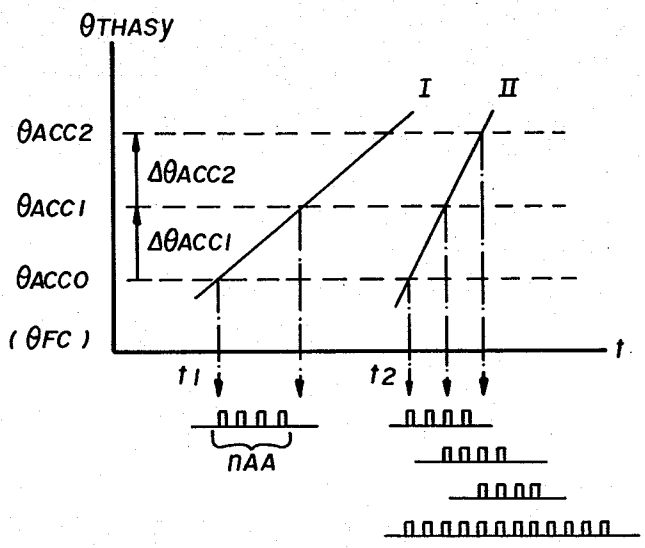
FIGS. 5 and 6 are diagrams each showing the number of valve opening pulses produced for a fuel injection valve relative to an amount of change of the throttle valve opening.
Figure 6:
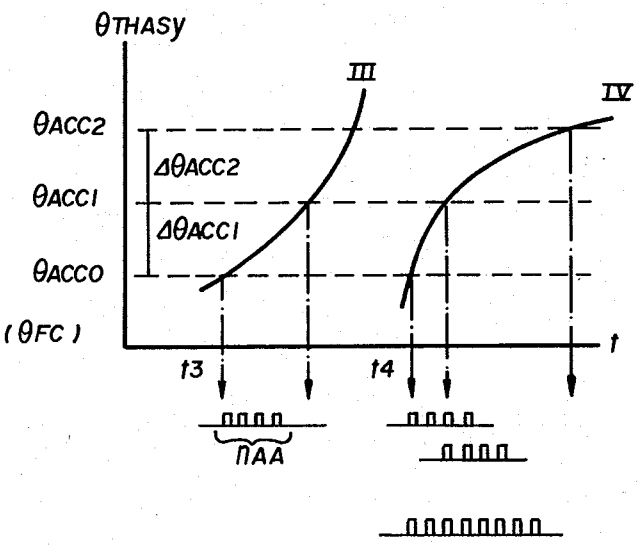

When the result of the determination at step 8 or step 16 is the affirmative (Yes), a number $n_{AAcc}$ of the asynchronous valve opening pulse signals, as shown in FIG. 5 or FIG. 6, are delivered to the fuel injection valve 6. Further, at step 17 and steps following step 17, a number by which the pulse number $n_{AAcc}$ is to be increased is determined depending upon the rate of change of the throttle valve opening $\theta_{THAsy}$, for example, as shown by the straight line I or II of FIG. 5 or as shown by the curves III or IV of FIG. 6, and thus a number of asynchronous valve openings pulses for the fuel injection valve 6 is determined.

At step 17, it is determined whether or not the throttle valve opening $\theta_{THAsy}$ exceeds the first reference value $\theta_{Acc1}$ or the second reference value $\theta_{Acc2}$, and when the result of the determination is negative (No), the process advances to step 20. However, when the result of the determination at step 17 is affirmative (Yes), it is determined whether or not the pulse number $n_{AAcc}$ set at step 12 is greater than 0, that is, whether the asynchronous acceleration increasing correction which was started at step 9 or step 15 has been completed or still continues (or in other words, whether or not the correction has come to an end) (step 18). When the result of the determination is affirmative (Yes), the predetermined value $n_{AA}$ is added to the remaining pulse number $n_{AAcc}$ for the present loop to increase the asynchronous opening number for the fuel injection valve 6 (step 19). However, when the result of the determination is negative (No), process goes directly to step 20.

At step 20, it is determined whether or not the differential valve $\Delta\theta_{THAsy}$ of the throttle valve opening $\theta_{THAsy}$ is lower than a predetermined negative value $G_A-$ (for example, −0.5° per 40 milliseconds), that is, whether or not the accelerator pedal has been released suddenly and as a result the throttle valve opening $\theta_{THAsy}$ has decreased suddenly. When the result of the determination is affirmative (Yes), the remaining pulse number $n_{AAcc}$ for the present loop is reset to 0 (step 22) and the flag $F_{Asy}$ is reset to 0 (step 23), and then process advances to step 15 with the value $Ti_A$ is left at 0 without calculating the same whereby the program comes to an end. Thus, at step 15, the value $T_{MA}$ becomes 0 so that no valve opening pulses will thereafter be delivered to the fuel injection valve 6, or in other words, the asynchronous acceleration increasing correction will be interrupted.

However, when the result of the determination at step 20 is negative (No), it is determined in a similar manner as at step 18 whether or not the pulse number $n_{AAcc}$ is greater than 0 (step 21). When the result of the determination is affirmative (Yes), steps 13 to 15 are carried out to continue the asynchronous acceleration increasing correction whereby the program comes to an end. Meanwhile, when the result of the determination at step 21 is negative (No), steps 23 and 15 are carried out. Consequently, the values $Ti_A$ and $T_{MA}$ become 0 so that the asynchronous acceleration increasing correction is ended, and the program comes to an end.

Now, a description will be given of a situation where, for example, the throttle valve opening $\theta_{THAsy}$ increased gradually as shown by the straight line I of FIG. 5 in a control procedure as described above. The predetermined number $n_{AA}$ of pulses (for example, 4 after completion of warming up) of asynchronous acceleration increasing corrections are started from a point of time $t_1$ either when the differential value $\Delta\theta_{THAsy}$ of the throttle valve opening $\theta_{THAsy}$ exceeds the predetermined value $G_A+$ or when the throttle valve opening $\theta_{THAsy}$ is opened from the almost closed position and the first and second reference values $\theta_{Accl}$ and $\theta_{Acc2}$ are thus determined. If the increasing correction comes to an end before the throttle valve opening $\theta_{THAsy}$ reaches the first reference value $\theta_{Accl}$ (the result of the decision at step 18 is negative (No)) while the engine rotational speed Ne exceeds the predetermined value $N_{EA}$, when the accelerating condition continues, only an ordinary synchronous acceleration increasing correction is carried out. However, when for example, the throttle valve opening $\theta_{THAsy}$ exhibits a sudden increase as seen from the straight line II of FIG. 5, the predetermined number $n_{AA}$ of asynchronous acceleration increasing corrections are started from a point of time $t_2$ similar to the point of time $t_1$. The increasing corrections continue even after the throttle valve opening $\theta_{THAsy}$ has reached the first reference value $\theta_{Accl}$ (the result of the determination at step 18 is affirmative (Yes)) because the throttle valve opening $\theta_{THAsy}$ increases rapidly. As a result, the predetermined pulse number $n_{AA}$ is added to the pulse number $n_{AAcc}$ (step 19), and hence a total of $n_{AAx2}$ asynchronous acceleration increasing corrections are carried out. In the example illustrated, the increasing corrections still continue even after the throttle valve opening $\theta_{THAsy}$ has reached the second reference value $\theta_{Acc2}$ (the result of the decision at step 18 is affirmative (Yes) again) because the throttle valve opening $\theta_{THAsy}$ increases rapidly. Thus, the predetermined number $n_{AA}$ is further added to the pulse number $n_{AAcc}$ (step 19), and accordingly a total of $n_{AAx3}$ asynchronous acceleration increasing corrections are carried out. Accordingly, asynchronous acceleration increasing corrections are effected for a sudden increase of the throttle valve opening as shown by the straight line II.

Meanwhile, when for example, the throttle valve opening $\theta_{THAsy}$ increases in a manner as seen in the curve III of FIG. 6, the predetermined number $n_{AA}$ of asynchronous acceleration increasing corrections are started from a point of time $t_3$ similar to the points of time $t_1$ and $t_2$. The increasing corrections end before the throttle valve opening $\theta_{THAsy}$ reaches the first reference value $\theta_{Accl}$ (the result of the decision at step 18 is negative (No)). In the meantime, when the engine rotational speed Ne exceeds the predetermined value $N_{EA}$, even if the throttle valve opening $\theta_{THAsy}$ thereafter rapidly increases, only synchronous acceleration increasing corrections are carried out for the rapid increase. However, when for example, the throttle valve opening $\theta_{THAsy}$ increases in a manner as seen from the curve IV of FIG. 6, the predetermined number $n_{AA}$ of asynchronous acceleration increasing corrections are started from a point of time $t_4$ similar to the points of time $t_1$ and $t_3$. The increasing corrections continue even after the throttle valve opening $\theta_{THAsy}$ has reached the first reference value $\theta_{Accl}$ (the result of the determination at step 18 is affirmative (Yes)). Thus, the predetermined number $n_{AA}$ is added to the pulse number $n_{AAcc}$ (step 19), and accordingly, a total of $n_{AAx2}$ asynchronous acceleration increasing corrections are carried out. The increasing corrections end before the throttle valve opening $\theta_{THAsy}$ reaches the second reference value (the result of the decision at step 18 is negative (No)). In the meantime, when the engine rotational speed Ne exceeds the predetermined value $N_{EA}$, only normal synchronous acceleration increasing corrections are carried out in an acceleration condition.

In this manner, asynchronous acceleration increasing corrections for precise valve opening operations of the throttle valve are effected.

As is apparent from the foregoing description, according to the present invention, a method of controlling fuel supply upon acceleration of an internal combustion engine is provided wherein a basic fuel supply amount which is determined in accordance with a normal operating condition of the engine is correctionally increased when the throttle valve of the engine is opened from its almost closed position. The method is characterized in that it comprises the steps of adding a predetermined value to a detected amount or value of the opening of the throttle valve when it is determined that the throttle valve is opened from its almost or substantially closed position to determine a reference value to the opening of said throttle valve. Additionally, the basic fuel supply amount is further correctionally increased if the correctional increase of the basic fuel supply amount which was initiated upon detection of opening of the throttle valve has not yet reached an end when the detected value of the opening of the throttle valve reaches the reference value. Accordingly, an increasing correction of fuel supply can be precisely effected in response to various ways of pushing down on an accelerator pedal from an almost closed position of a throttle valve, that is, in response to various changes of the opening of the throttle valve.

A further aspect of the method of controlling fuel supply upon acceleration of an internal combustion engine is provided wherein a basic fuel supply amount which is determined in response to a normal operating condition of said engine is correctionally increased when a differential value of a detected value corresponding to a load on the engine exceeds a predetermined value. The method comprises the steps of adding a predetermined value to the detected value of the engine load to determine a reference value of the engine load. When the differential value of the engine load exceeds the predetermined value, the correctionally increased basic fuel supply amount is additionally corrected if the correctional increase of the basic fuel supply amount which was started when the differential value of the engine load exceeded the predetermined value has not ended when the detected value of the engine load reaches the reference value. Accordingly, the fuel supply can be increased appropriately even if a change in load on the engine is quick or comes to an end in a short time. Further, a correctional increase of the fuel supply can be attained which corresponds to a precise change in the engine load.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. In a method of controlling fuel supply during beginning acceleration and acceleration after a fuel cut of an internal combustion engine including detecting the amount of opening of a throttle valve, generating a throttle signal as a function thereof and providing a first correctional increase to the basic fuel supply amount upon detecting the throttle signal indicating beginning acceleration or acceleration after a fuel cut, said method comprising the steps of detecting a throttle signal indicating that said throttle valve is opened from a predetermined beginning acceleration or fuel cut position; immediately providing the first correctional increase in response to the throttle signal indicating said predetermined throttle valve opening position during a predetermined time period; adding a predetermined value to the detected value of the opening of said throttle valve upon detection that said throttle valve is opened from the beginning acceleration or fuel cut position, the sum becoming a reference value for the opening of said throttle valve; and providing as a function of noncompletion of the first correctional increase an additional correctional increase to the first correctionally increased basic fuel supply amount if the first correctional increase of the basic fuel supply amount, initiated upon detection of the throttle signal indicating the beginning of acceleration or fuel cut position, is not complete when the detection amount of the opening of said throttle valve reaches the reference value.

2. A method of controlling fuel supply during acceleration of an internal combustion engine according to claim 1, wherein the additional correctional increase has an asynchronous relationship with a crank angle signal generated at a predetermined angular position of a crank of said engine.

3. A method of controlling fuel supply during acceleration of an internal combustion engine according to claim 2, wherein the fuel supply is controlled by applying a driving signal comprising a plurality of pulses to a fuel injection valve, and the additional correctional increase is effected by increasing the number of pulses of the driving signal applied to the fuel injection valve.

4. In a method of controlling fuel supply during acceleration of an internal combustion engine including detecting the load on the engine, generating an engine load signal a function thereof and providing a first correctional increase to the basic fuel supply amount when engine load signals indicate a differential value of the load on said engine exceeds a predetermined value during a predetermined period of time, said method comprising the steps of detecting engine load signals and indicating when a differential value of the load on the engine exceeds a predetermined value during a predetermined period of time, immediately adding the first correctional increase to the basic fuel supply when the differential value of the detected value of the load exceeds the predetermined value, adding a predetermined value to the detected value of the engine load, the sum becoming a reference value for the engine load when the differential value of the engine load exceeds the predetermined value, and providing as a function of non-completion of the first correctional increase an additional increase to the first correctionally increased basic fuel supply amount if the first correctional increase of the basic fuel supply amount, initiated when the engine load signal indicates the differential value of the engine load exceeded the predetermined value, is not complete when the detected value of the engine load reaches the reference value.

5. A method of controlling fuel supply during acceleration of an internal combustion engine according to claim 4, wherein the additional correctional increase has an asynchronous relationship with a crank angle signal which is generated at a predetermined angular position of a crank of said engine.

6. A method of controlling fuel supply during acceleration of an internal combustion engine according to claim 5, wherein the additional correctional increase is effected by increasing the number of pulses of a driving signal applied to the fuel injection valve.

7. A method of controlling the fuel supply during the acceleration of an internal combustion engine, said method comprising the steps of: detecting the beginning of acceleration and generating a beginning of acceleration signal as a function thereof; immediately providing a first increase in the fuel supply upon detecting the beginning of acceleration signal indicating the beginning of acceleration during a predetermined period of time; setting a reference value corresponding to a position of an accelerator pedal when the beginning of acceleration signal is detected; determining when the acceleration pedal reaches a position corresponding to the reference value; and providing as a function of non-completion of the first correctional increase a second increase in the fuel supply if the accelerator pedal reaches the position corresponding to the reference value before the first increase in fuel supply is completed.

8. A method of controlling fuel supply during acceleration of an internal combustion engine, said method comprising the steps of: detecting the throttle angle of the engine and generating a throttle angle signal as a function thereof; immediately generating a first fuel supply enrichment signal during a predetermined period of time when the throttle angle of the throttle valve of the engine is greater than a predetermined throttle angle; generating a reference throttle angle signal; generating as a function of non-completion of the first fuel supply enrichment signal, a second fuel supply enrichment signal when the throttle angle signal reaches the value of the reference throttle angle signal before completion of the first enrichment signal; and preventing the second fuel supply enrichment signal when the first enrichment signal is completed before the throttle angle signal reaches the value of the reference throttle angle signal.

* * * * *